US005890932A

United States Patent [19]

Muta

[11] Patent Number: 5,890,932

[45] Date of Patent: Apr. 6, 1999

[54] CONNECTOR

[75] Inventor: Junji Muta, Yokkaichi, Japan

[73] Assignee: Sumitomo Wiring Systems, Ltd., Yokkaichi, Japan

[21] Appl. No.: 613,193

[22] Filed: Mar. 8, 1996

[30] Foreign Application Priority Data

Mar. 13, 1995 [JP] Japan ..... 7-081878

[51] Int. Cl.[6] ..... H01R 13/10

[52] U.S. Cl. ..... 439/682

[58] Field of Search ..... 439/682, 683, 439/684, 685, 686, 687, 688, 689, 690, 691, 692, 842, 843, 844, 845, 858, 861, 862, 852

[56] References Cited

U.S. PATENT DOCUMENTS

| | | | |
|---|---|---|---|
| 5,240,434 | 8/1993 | Yagi et al. | 439/535 |
| 5,292,262 | 3/1994 | Endo et al. | 439/752 |
| 5,399,108 | 3/1995 | Lu et al. | 439/682 |

FOREIGN PATENT DOCUMENTS

| | | |
|---|---|---|
| 3813948 A1 | 11/1989 | Germany . |
| 4234976 A1 | 4/1993 | Germany . |
| U-4-80260 | 7/1992 | Japan . |

*Primary Examiner*—Gary Paumen
*Assistant Examiner*—Yong Ki Kim
*Attorney, Agent, or Firm*—Oliff & Berridge, PLC

[57] ABSTRACT

A resilient contact piece portion is provided within a connection portion of a female metal terminal, and is folded back at a position spaced forwardly from a front end of the connection portion, thus forming a folded portion of a generally inverted V-shaped cross-sectional shape. Relief recesses for respectively receiving the projected folded portions are formed in a front plate of cavities in a female housing. Thus, a contact portion is shifted forwardly within the connection portion while the cross-sectional shape remains unchanged as before. The contact portion of the resilient contact piece portion is shifted forwardly, and therefore even if the length of projecting of a tab portion is short, a positive electrical connection between the tab portion and the resilient contact piece portion is achieved.

12 Claims, 5 Drawing Sheets

CONNECTOR

BACKGROUND OF THE INVENTION

This invention relates to a connector, and more particularly to a connector in which tab portions of male metal terminals can not be projected sufficiently long.

A connector of the type for direct connection to a motor (for example, a drive portion of a power window of an automobile) is constructed as shown in FIGS. 9 and 10. A housing 61 is mounted directly on the motor, and a tab portion 64 of each male metal terminal 63 is projected into a recess 62 formed in the housing 61, thereby forming a male connector 65. A mating female connector 66 includes a housing 67 for being received in the recess 62 in the male connector 65, and female metal terminals 69 are mounted respectively in cavities 68 formed in the housing 67. A tubular connection portion 70 of a square cross-section for receiving the tab portion 64 is formed at a front end of the female metal terminal 69. Provided within the connection portion 70 is a resilient, deformable contact piece portion 71 which is folded or turned back at the front end of the connection portion 70 into a generally inverted-V shape. When the female connector 66 is fitted into the recess 62 in the male connector 65, the tab portion 64 is inserted through a terminal insertion port 73, formed through a front plate 72 of the cavity 68, into the connection portion 70 of the female metal terminal 69, and is resiliently engaged with the resilient contact piece portion 71, thereby creating an electrical connection.

In such a motor direct-connection connector, the configuration of the housing 61 to be mounted on the motor is limited because of a mounting space, and therefore the length of projecting of the tab portion 64 of the male metal terminal 63 is often limited. If the length of projecting of the tab portion 64 is not sufficient, the front end of the tab portion 64 does not sufficiently reach the apex (serving as a contact portion) of the resilient contact piece portion 71 as shown in FIG. 10 when the female connector 66 is fitted in the male connector, and therefore the area of contact between the two is insufficient, so that the positive contact between the two may not be achieved.

To avoid this, it may be proposed to change the configuration of the resilient contact piece portion so that even the short tab portion can positively contact it. However, it is expected that much time and cost are required for the development of such new configuration including the analysis of resilient deformation of the resilient contact piece portion, and therefore the cost would be greatly increased.

SUMMARY OF THE INVENTION

The present invention has been made under the above circumstances, and an object of the invention is to provide a connector in which even if a tab portion can not be projected sufficiently long, a positive electrical connection can be achieved, and the increase of the cost is kept to a low level.

The above object has been achieved by a connector of the present invention wherein male metal terminals are mounted on a male connector housing in such a manner that tab portions of the terminals are projected; female metal terminals are mounted respectively in cavities formed in a female connector housing; the female metal terminal has a connection portion for receiving the tab portion; a resilient contact piece portion, folded back at a front end of the connection portion, is resiliently deformably provided within the connection portion; and when the male and female connector housings are fitted together, each of the tab portions is inserted through a terminal insertion hole, formed through a front plate of the cavity in the female connector housing, into the connection portion of the associated female metal terminal, and resiliently contacts the resilient contact piece portion; characterized in that the folded portion of the resilient contact piece portion is projected forwardly from the front end of the connection portion; and relief recesses for respectively receiving the folded portions of the resilient contact piece portions are formed in the front plate of the female connector housing.

The operation of the present invention is as follows: The folded portion of the resilient contact piece portion is projected forwardly from the front end of the connection portion, and therefore a contact portion of this resilient contact piece portion for contact with the tab portion is disposed more forwardly within the connection portion. The female metal terminal of this construction is mounted in the cavity in the female connector housing in such a manner that the projected folded portion of the resilient contact piece portion is received in the relief recess. When the female and male connector housings are fitted together, the tab portion, even if projected short, can positively contact the resilient contact piece portion since the contact portion of the resilient contact piece portion is disposed sufficiently forwardly within the connection portion.

In the present invention, the contact portion of the resilient contact piece portion of the female metal terminal is disposed sufficiently forwardly within the connection portion, and therefore even if the length of projecting of the tab portion is short, the resilient contact piece portion can positively contact the tab portion. And besides, in the resilient contact piece portion, merely the folded portion is projected from the front end of the connection portion, and its shape is not changed, and therefore it is not necessary to make an analysis of resilient deformation of the resilient contact piece portion. Therefore, the time and cost required for changing the design can be suppressed to a minimum, and the connector can be produced at low costs.

DETAILED DESCRIPTION OF PREFERRED EMBODIMENTS

First Embodiment

Figure 1:
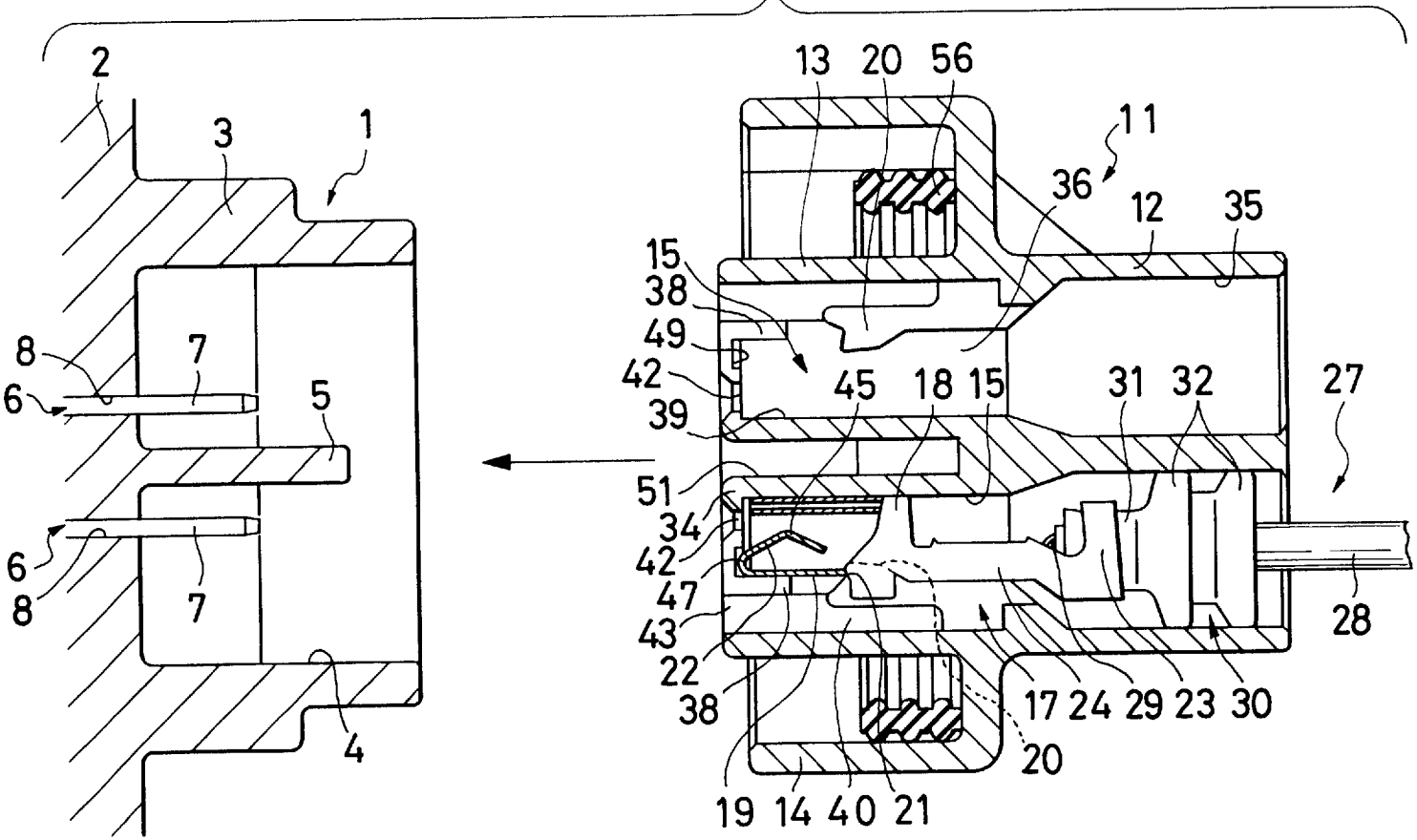
FIG. 1 is a horizontal cross-sectional view of a first embodiment of the present invention, showing a condition before female and male connectors are fitted together.
Figure 2:
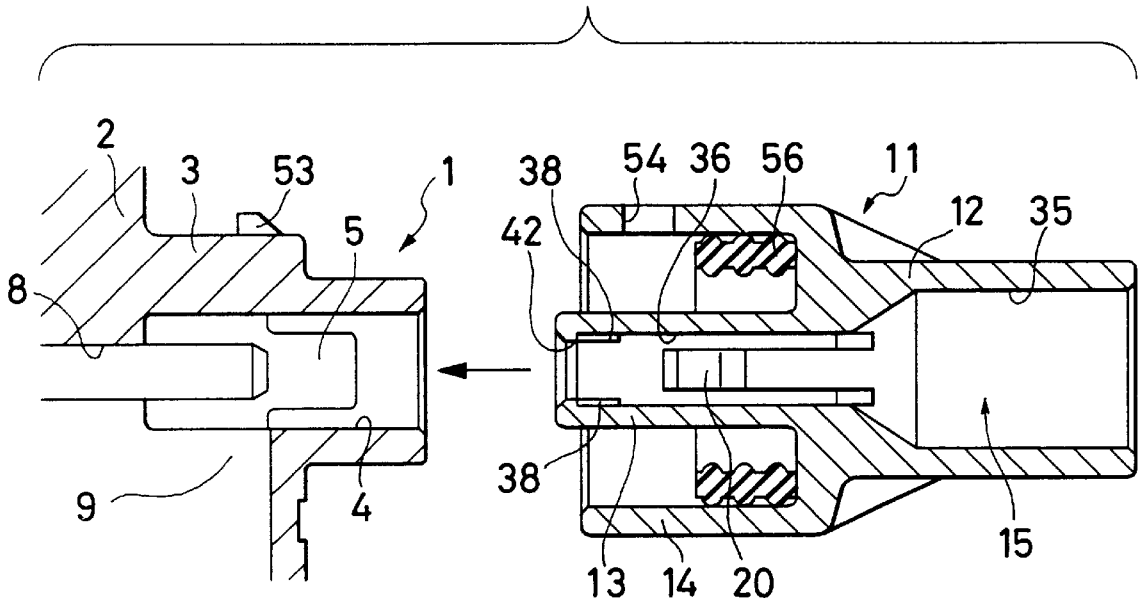
FIG. 2 is a vertical cross-sectional view of the above embodiment.

FIGS. 1 to 7 shows a first embodiment of the present invention. In FIGS. 1 and 2, a male connector 1 is provided integrally on an outer surface of a housing 2 of a synthetic resin mounted on an output side of a motor (not shown).

Referring to the male connector 1 in further detail, a tubular portion 3 of a generally flatted square shape is formed on and projects from a predetermined portion of the outer surface of the housing 2, and a fitting recess 4 is defined by the inner surface of the tubular portion 3. A peripheral wall of a distal end portion of the tubular portion 3 is reduced in thickness to provide a stepped portion. A partition wall 5 is formed within the fitting recess 4, and is disposed centrally of the width of this recess 4, and tab portions 7 of a pair of male metal terminals 6 (which are connected to a brush of the motor (not shown)) are received in the fitting recess 4 in parallel relation to each other, and are disposed respectively on opposite sides of the partition wall 5. Mounting grooves 8 for respectively receiving the tab portions 7 are formed in a wall defining an inner surface of the fitting recess 4, and each tab portion 7 is inserted into an insertion space 9 (which communicates with the mounting groove 8) from the lower side, and is press-fitted into the mounting groove 8 as shown in FIG. 2. Thus, each tab portion 7 is projected from the inner surface of the fitting recess 4 to a position disposed generally centrally of the depth thereof.

A female connector 11 to be fitted on the male connector 1 is of the waterproof type, and comprises a housing 12 of a synthetic resin. This housing 12 has at one end a fitting portion 13 which can be snugly fitted in the fitting recess 4 in the male connector 1, and a hood portion 14 for covering the outer surface of the tubular portion 3 of the male connector 1 is formed around the fitting portion 13. A pair of cavities 15 for respectively receiving female metal terminals 17 are formed in the housing 12 of the female connector.

The female metal terminal 17 is formed by pressing a single metal sheet into a predetermined shape, and has at its front end a tubular connection portion 18 of a square cross-section for receiving the tab portion 7 of the male metal terminal 6. A retaining hole 21, in which a lance 20 formed on the housing 12 is engageable, is formed through a bottom plate 19 of the connection portion 18. A resilient contact piece portion 22 for contact with the tab portion 7 is formed within the connection portion 18. This resilient contact piece portion 22 will be more fully described later. The female metal terminal also has an insulation barrel 23 and a wire barrel 24 at its rear end portion.

A sealing rubber plug 30 of a tubular shape is fitted on an end portion of a sheath 28 of a wire 27. A front end portion of the rubber plug 30 defines a clamping portion 31 of a smaller diameter, and a pair of spaced, annular seal portions 32 are formed on a rear end portion of the rubber plug 30. The insulation barrel 23 is clamped to the outer periphery of the clamping portion 31 of the rubber plug 30, and the wire barrel 24 is clamped to an end of a conductor 29 extending from the end of the sheath 28. Thus, the female metal terminal 17 and the rubber plug 30 is secured to the end portion of the wire 27.

Figure 5:
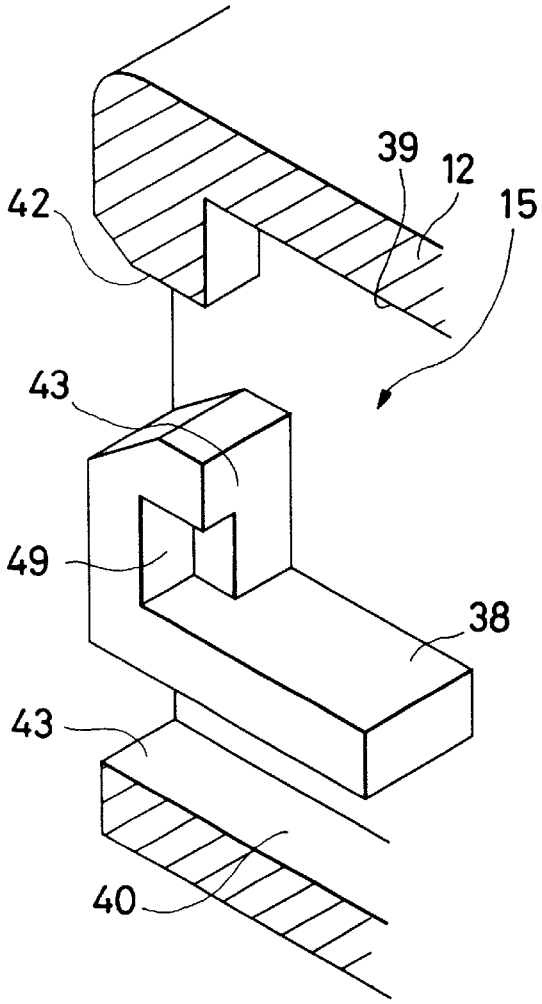
FIG. 5 is an enlarged perspective view of a portion of a housing.
Figure 6:
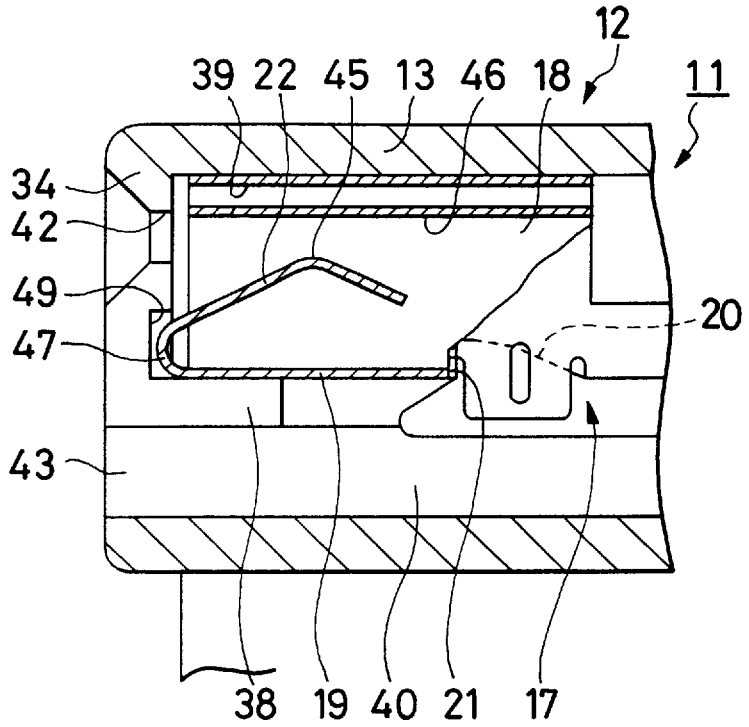
FIG. 6 is an enlarged, vertical cross-sectional view showing a condition in which the female metal terminal is received in a cavity.
Figure 7:
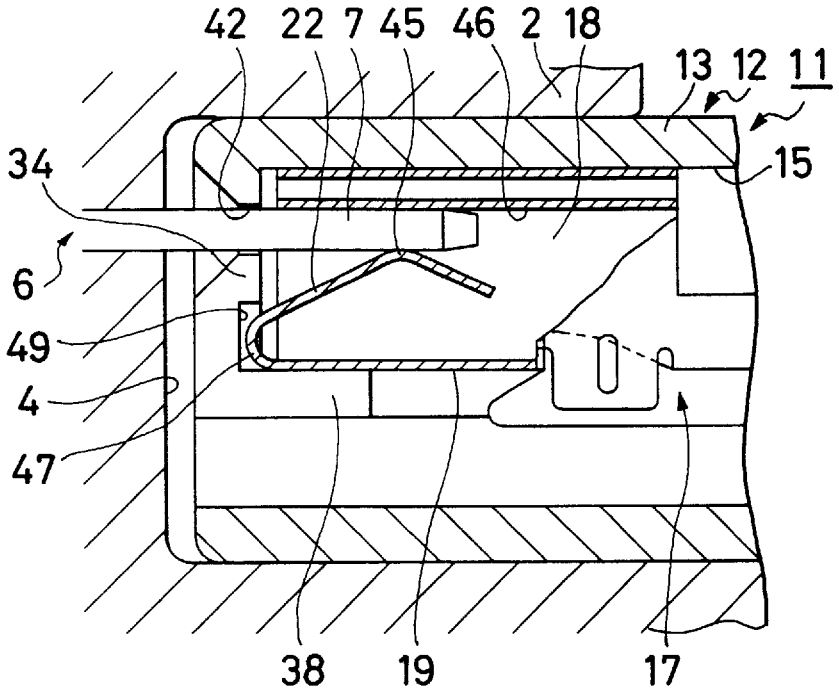
FIG. 7 is an enlarged, vertical cross-sectional view showing a condition in which the female and male connectors are fitted together.

The cavities 15 are arranged symmetrically with respect to a median plane disposed centrally of the width of the housing 12 as shown in FIG. 1. Each cavity 15 has an open rear end (right end in FIG. 1) for passing the female metal terminal 17 therethrough, and has at its front end a front plate 34 against which the front end of the connection portion 18 of the female metal terminal 17 can be held. The rear end portion of the cavity 15 is formed into a circular hole 35 into which the rubber plug 30 is snugly fitted. The front end portion of the cavity 15 is formed into a cross-sectionally square hole 36 in which opposite side surfaces of the connection portion 18 of the female metal terminal 17 can be snugly fitted. As shown in FIGS. 5 and 6, a pair of guide portions 38, extending along the axis of the cavity 15, are projectingly formed on opposite side surfaces of the square hole 36 in continuous relation to the front plate 34, and each of upper and lower surfaces of the connection portion 18 is snugly fitted between the associated guide portion 38 and a surface 39 of the square hole 36 facing the guide portion 38.

The lance 20 for engagement in the retaining hole 21 in the female metal terminal 17 to retain this terminal 17 is provided rearwardly of the two guide portions 38 within the cavity 15. This lance 20 is elastically deformable, and a relief space 40 for the lance 20 is formed outwardly of that area of the square hole 36 where the guide portions 38 are formed.

A terminal insertion hole 42 is formed through the front plate 34 of the cavity 15, and the tab portion 7 of the male metal terminal 6 can be inserted through this insertion hole 42 into the connection portion 18 of the female metal terminal 17. An insertion hole 43 for passing a jig therethrough is formed forwardly of the relief space 40 for the lance 20, and the retained condition of the female metal terminal 17 can be released by inserting the jig and then by forcibly elastically deforming the lance 20. The space between the two guide portions 38 communicates at its front side with the terminal insertion hole 42 and the jig insertion hole 43, as shown in FIG. 5.

Figure 4:
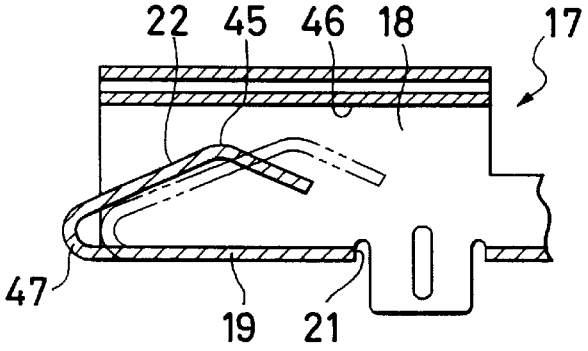
FIG. 4 is an enlarged, vertical cross-sectional view of a portion of a female metal terminal.

As shown in detail in FIG. 4, the resilient contact piece portion 22, provided within the connection portion 18 of the female metal terminal 17, is formed by a strip portion extending from the front end of the bottom plate 19 of the connection portion 18. More specifically, this strip portion is folded or turned back at a position forwardly spaced a predetermined distance from the front end of the connection portion 18 to thereby provide a folded portion 47, and is formed into a generally inverted V-shaped cross-sectional shape. This resilient contact piece portion 22 is resiliently deformable, and holds the tab portion 7 of the male metal terminal 6, inserted into the connection portion 18, between the apex of the V-shaped portion (which serves as a contact portion 45) and a ceiling surface 46 of the connection portion 18, thereby achieving an electrical connection.

The resilient contact piece portion 22 has the same cross-sectional shape as that of the conventional resilient contact piece portion indicated in phantom in FIG. 4. However, although the folded portion of the conventional contact piece portion is disposed at the front end of the connection portion 18, the folded portion 47 of the resilient contact piece portion 22 of this embodiment is projected or spaced forwardly from the front end of the connection portion 18, as described above. Therefore, although the two have the same cross-sectional shape, the contact portion 45 of the resilient contact piece portion 22 of this embodiment is disposed more forwardly within the connection portion 18 by an amount corresponding to the amount of projecting of the folded portion 47.

As shown in FIGS. 5 and 6, a relief recess 49 for receiving the projected folded portion 47 of the resilient contact piece portion 22 is formed in the front plate 34 in continuous relation to the upper surface of the guide portion 38, and a depth of this relief portion 49 is generally equal to a half of the thickness of the front plate 34.

A guide groove 51 for receiving the partition wall 5 of the male connector 1 is formed in the front surface of the housing 12 of the female connector, and is disposed centrally of the width of this housing. As shown in FIG. 2, a lock projection 53 is formed on the outer surface of the tubular portion 3 of the male connector 1, and a lock hole 54 for receiving this lock projection 53 is formed through the hood portion 14 of the female connector 11. A seal ring 56 is fitted in an inner end portion of the hood portion 14.

This embodiment is constructed as described above, and the assembling operation thereof will now be described. The pair of female metal terminals 17 are inserted respectively into the cavities 15 in the female connector housing 12 from the rear side in symmetrical relation to each other. The connection portion 18 of each female metal terminal 17 passes through the circular hole 35 in the cavity 15, and then elastically deforms the lance 20, and is inserted between each guide portion 38 and the surface 39, and the folded portion 47 of the resilient contact piece portion 22, projecting from the front end of the connection portion 18, is relieved or received into the relief recess 49 in the front plate 34.

When the front end of the connection portion 18 abuts against the front plate 34, the lance 20 is restored to be engaged in the retaining hole 21 as shown in FIG. 6, so that the female metal terminal 17 is received within the cavity 15 against withdrawal. In this condition, the annular seal portions 32 of the rubber plug 30 are closely fitted in the inner peripheral surface of the circular hole 35. The seal ring 56 is fitted into the inner end portion of the hood portion 14.

Figure 3:
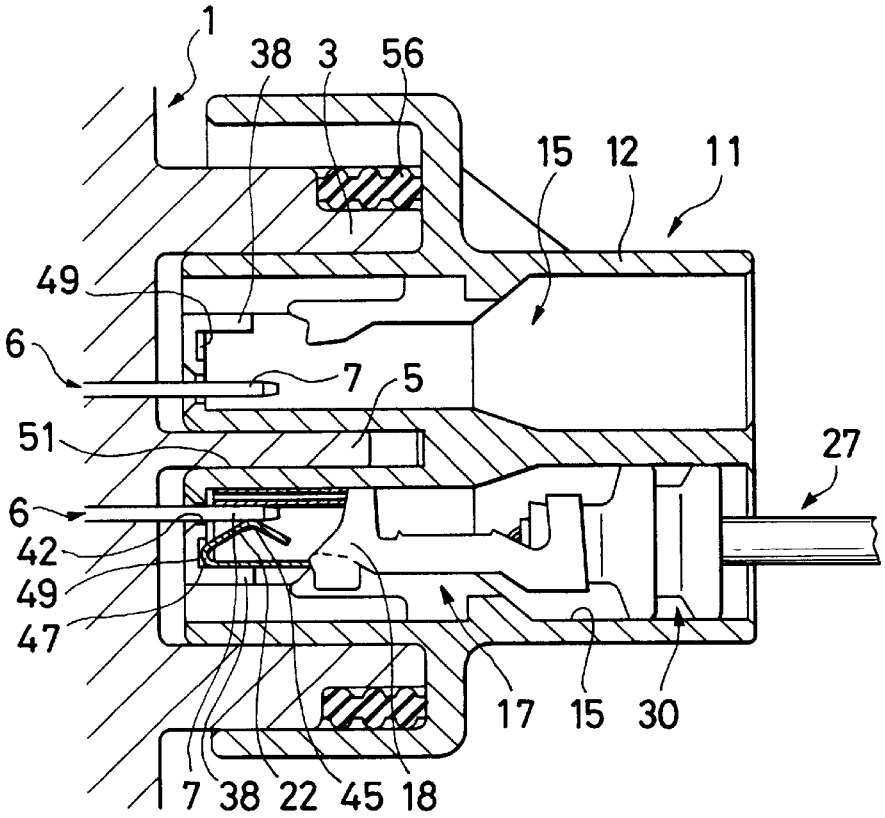
FIG. 3 is a horizontal cross-sectional view of the above embodiment, showing a condition after the connectors are fitted together.

The housing 12 of the thus assembled female connector 11 is inserted into the fitting recess 4, with the partition wall 5 of the male connector 1 received in the guide groove 51, and the hood portion 14 is elastically deformed to slide over the lock projection 53. When the housing is inserted until the inner end surface of the hood portion 14 is brought into contact with the front end of the tubular portion 3 of the male connector as shown in FIG. 3, the hood portion 14 is elastically restored, and the lock projection 53 is fitted into the lock hole 54, so that the female connector 11 is fitted in the male connector 1 against withdrawal.

In accordance with the fitting of the female connector 11, the tab portion 7 of each male metal terminal 6 is inserted through the terminal insertion hole 42, formed through the front plate 34 of the female housing 12, into the connection portion 18 of the associated female metal terminal, and resiliently deforms the resilient contact piece portion 22, and is further inserted into the space between the contact portion 45 and the ceiling surface 46 of the connection portion 18, and therefore is resiliently held therebetween, thereby creating an electrical connection between the male and female metal terminals 6 and 17. The rubber plug, fixedly mounted on the end portion of the wire 27, is fitted in the circular hole 35 in the cavity 15, and therefore water is prevented from intruding into the cavity 15. A seal between the tubular portion 3 of the male connector 1 and the hood portion 14 of the female connector 11 is formed by the seal ring 56, and therefore water is prevented from intruding therebetween.

As described above, in this first embodiment, since the folded portion 47 of the resilient contact piece portion 22 of the female metal terminal 17 is projected forwardly from the front end of the connection portion 18, the contact portion 45 of the resilient contact piece portion 22 can be disposed more forwardly within the connection portion 18. Therefore, this resilient contact piece portion can positively contact the short tab portion 7 which could not be easily contacted by the conventional resilient contact piece portion. And besides, in the resilient contact piece portion 22, merely the folded portion 47 is projected from the front end of the connection portion 18, and its cross-sectional shape is not changed, and therefore it is not necessary to make an analysis of resilient deformation of the resilient contact piece portion 22. Therefore, the time and cost required for changing the design can be suppressed to a minimum, and the connector can be produced at low cost.

As a result of projecting the folded portion 47 of the resilient contact piece portion 22, the relieve recesses 49 for respectively receiving these folded portions 47 are merely formed in the front plate 34 of the housing 12, and the thickness of the front plate 34 is not changed, and therefore the strength of the housing 12 is not reduced. Furthermore, since the female connector 11 is of the waterproof type, there is no need to provide any seal portion on the housing 2 mounted on the motor, and therefore this motor-side housing 2 can be simple in construction, and the mounting of the male metal terminals 6 becomes easy.

Female metal terminals of the ordinary type, in which a resilient contact piece portion is folded back at a front end of a connection portion, can also be attached to the female housing 12 of this embodiment.

Second Embodiment

Figure 8:
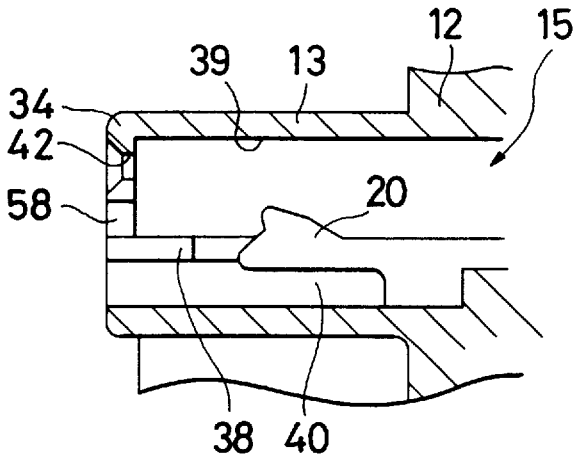
FIG. 8 is a vertical cross-sectional view of a portion of a housing in a second embodiment.
Figure 9:
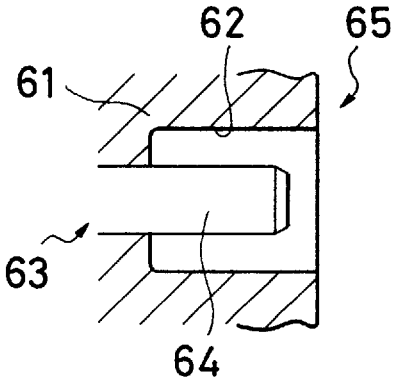
FIG. 9 PRIOR ART
FIG. 9 is a vertical cross-sectional view showing a conventional male connector.
Figure 10:
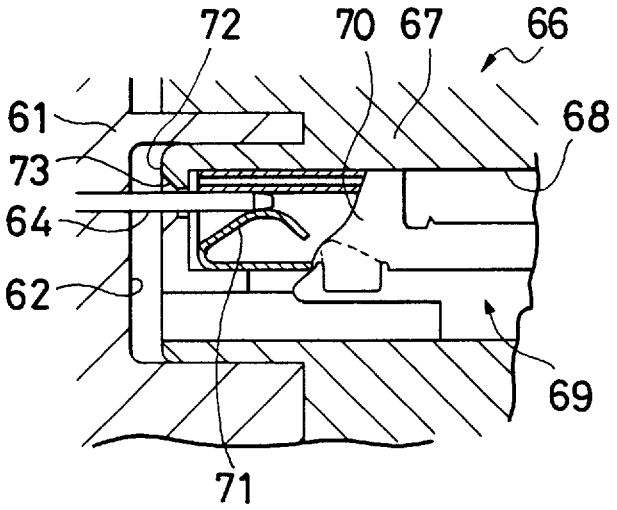
FIG. 10 PRIOR ART
FIG. 10 is a horizontal cross-sectional view showing a condition in which female and male connectors are fitted together.

FIG. 8 shows a second embodiment of the invention. In the first embodiment, means for relieving the projected folded portion 47 of the resilient contact piece portion 22 is defined by the relief recess 49 of the blind hole type formed in the front plate 34 of the cavity. In the second embodiment, instead of the relief recesses 49, through holes 58 are formed through the front plate 34, and hence extend to the front surface of the front plate 34. The other construction and effects are the same as described above in the first embodiment.

The present invention is not to be limited to the embodiments described above with reference to the drawings, and for example, the following embodiments fall within the scope of the present invention, and further other various modifications can be made without departing from the scope of the invention.

In the above embodiments, the pair of cavities in the female housing are separated from each other, and the terminal insertion holes are provided at the inward portion of the housing in generally opposed relation to each other; however, other arrangements may be adopted. For example, terminal insertion holes may be arranged to face away from each other at the outward portion, or may be arranged parallel to each other in the same direction, or may be arranged to face away from each other, with no partition wall provided.

The present invention can be applied not only to the motor direct-connection-type connector but also can be extensively applied to connectors in which male and female metal terminals, received in respective housings, are fitted together, and a tab portion of each male metal terminal can not be projected sufficiently long.

What is claimed is:

1. A connector comprising:

a male connector housing in which male metal terminals are mounted in such a manner that tab portions of said terminals are projected; and a female connector housing in which female metal terminals are mounted respectively in cavities formed therein; each of said female metal terminals including a connection portion for receiving said tab portion, the connection portion having a resilient contact piece portion which is folded back at a front end of said connection portion, is resiliently deformable and is projected forwardly from an inner plane of a front wall of said cavity in said female connector housing;

wherein a relief recess for receiving an end of said connection portion is formed in said front wall of said cavity in said female connector housing and wherein when said male and female connector housings are fitted together, each of said tab portions is inserted through a terminal insertion hole, formed through said front wall of said cavity in said female connector housing, into said connection portion of the associated female metal terminal, and resiliently contacts said resilient contact piece portion.

2. A connector comprising:

a male connector housing in which male metal terminals are mounted in such a manner that tab portions of said terminals are projected; and a female connector housing in which female metal terminals are mounted respectively in cavities formed therein; each of said female metal terminals including a connection portion for receiving said tab portion;

wherein a relief recess for receiving an end of said connection portion is formed in a front wall of said cavity in said female connector housing, the depth of said relief recess being equal to a half of a thickness of said front wall.

3. A connector as claimed in claim 2, wherein said connection portion is projected forwardly from an inner plane of said front wall.

4. A connector comprising:

a male connector housing in which male metal terminals are mounted in such a manner that tab portions of said terminals are projected; and a female connector housing in which female metal terminals are mounted respectively in cavities formed therein; each of said female metal terminals including a connection portion for receiving said tab portion;

wherein a relief recess for receiving an end of said connection portion is formed in a front wall of said cavity in said female connector housing, said relief recess being a through hole formed on said front wall.

5. A connector as claimed in claim 4, wherein said connection portion is projected forwardly from an inner plane of said front wall.

6. A connector comprising:

a male connector housing directly mounted on an electrical equipment and in which male metal terminals are mounted in such a manner that tab portions of said terminals are projected; and a female connector housing in which female metal terminals are mounted respectively in cavities formed therein; each of said female metal terminals including a connection portion for receiving said tab portion, said connection portion projecting forwardly from an inner plane of a front wall of said cavity in said female connector housing;

wherein a relief recess for receiving an end of said connection portion is formed in said front wall of said cavity in said female connector housing.

7. A connector, comprising:

a male connector housing having a base portion and a tubular portion projecting from said base portion, wherein male metal terminals are mounted on said male connector housing in such a manner that tab portions of said terminals project from said base portion; and a female connector housing in which female metal terminals are mounted respectively in cavities formed therein; each of said female metal terminals including a connection portion for receiving said tab portion, said connection portion projecting forwardly from an inner plane of a front wall of said cavity in said female connector housing;

wherein a relief recess for receiving an end of said connection portion is formed in said front wall of said cavity in said female connector housing.

8. A connector as claimed in claim 7, wherein said connection portion has a resilient contact piece portion which is folded back at a front end of said connection portion and is resiliently deformable; and when said male and female connector housings are fitted together, each of said tab portions is inserted through a terminal insertion hole, formed through said front wall of said cavity in said female connector housing, into said connection portion of the associated female metal terminal, and resiliently contacts said resilient contact piece portion.

9. A connector as claimed in claim 8, wherein said folded portion of said resilient contact piece portion is projected forwardly from the inner plane of said front wall.

10. A connector as claimed in claim 7, wherein a depth of said relief recesses is equal to a half of a thickness of said front wall.

11. A connector as claimed in claim 7, wherein said relief recesses are a through hole formed on said front wall.

12. A connector as claimed in claim 7, wherein said male connector housing is directly mounted on an electrical equipment.

* * * * *